US005964507A

United States Patent [19]

Blackstock et al.

[11] Patent Number: 5,964,507

[45] Date of Patent: Oct. 12, 1999

[54] TRANSMISSION GEARCASE FOR MULTIPLE CUTTING HEADS

[75] Inventors: Jon C. Blackstock, Ironton, Ohio; John A. Baird, Jr., Flatwoods; Ian T. Carr, Ashland, both of Ky.

[73] Assignee: Mining Technologies, Inc., Ashland, Ky.

[21] Appl. No.: 08/954,602

[22] Filed: Oct. 20, 1997

[51] Int. Cl.[6] ..... E21C 25/52; E21C 25/08

[52] U.S. Cl. ..... 299/76; 299/78

[58] Field of Search ..... 299/76, 78

[56] References Cited

U.S. PATENT DOCUMENTS

| | | | |
|---|---|---|---|
| 1,473,498 | 11/1923 | Morgan | 299/31 |
| 2,020,003 | 11/1935 | Sloane | 299/71 |
| 2,643,106 | 6/1953 | McGowan | 299/78 |
| 2,677,536 | 5/1954 | Gleeson | 299/85.1 |
| 2,689,117 | 9/1954 | Lunderg | 299/76 |
| 3,290,096 | 12/1966 | Stalker | 299/78 |
| 3,355,215 | 11/1967 | Haspert et al. | 299/60 |
| 3,773,384 | 11/1973 | Anderson | 299/76 |
| 3,774,969 | 11/1973 | LeBegue | 299/76 |
| 3,799,615 | 3/1974 | Taylor et al. | 299/59 |
| 4,098,839 | 7/1978 | Wilms et al. | 585/526 |
| 4,183,585 | 1/1980 | Brennan | 299/43 |
| 4,212,497 | 7/1980 | Borowski et al. | 299/53 |
| 4,225,189 | 9/1980 | LeBegue | 299/71 |
| 4,270,803 | 6/1981 | Baum | 299/76 |
| 4,470,636 | 9/1984 | Paurat et al. | 299/81.2 |
| 4,582,363 | 4/1986 | LeBegue et al. | 299/76 |
| 4,755,002 | 7/1988 | Parrott | 299/81.2 |
| 4,786,112 | 11/1988 | Brandl | 299/76 |
| 4,828,326 | 5/1989 | Schupphaus et al. | 299/42 |
| 4,953,916 | 9/1990 | Brandl | 299/76 |
| 5,098,166 | 3/1992 | Ebner et al. | 299/81.2 |
| 5,143,423 | 9/1992 | LeBegue et al. | 299/76 |

*Primary Examiner*—David Bagnell
*Assistant Examiner*—John Kreck
*Attorney, Agent, or Firm*—King and Schickli

[57] ABSTRACT

An apparatus is provided for mining a mineral seam. The apparatus includes a frame, a propulsion system as well as first and second cutters and a cutter motor for winning aggregate material from the mineral seam. The apparatus is characterized by the cutter including a transmission gearcase having a bevel gear set, first and second sun gears, first and second planetary gear sets, first and second fixed planetary gear set carriers and first and second rotating ring gears. The output from the drive motor is connected to the bevel gear set which in turn drives the first and second sun gears which in turn drive the respective first and second planetary gear sets that in turn drive the first and second ring gears. The ring gears drive the first and second cutters, respectively.

9 Claims, 6 Drawing Sheets

TRANSMISSION GEARCASE FOR MULTIPLE CUTTING HEADS

TECHNICAL FIELD

The present invention relates generally to the art of mining and, more particularly, to an improved mining apparatus adapted for more efficient mining of thin mineral seams as well as to a gearcase for such a mining apparatus.

BACKGROUND OF THE INVENTION

Continuous miners of the milling or drum-type are well known to those skilled in the art. Each such mining machine or apparatus s incorporates two or more cutting drums or heads that are rotated parallel to the mineral face. Each of the cutting drums includes a series of picks that serve to cut aggregate material from the mineral seam such as a coal seam. Mining machines of this type are utilized in both continuous mining systems and highwall mining systems such as described in, for example, U.S. Pat. Nos. 5,112,111; 5,261,729 and 5,364,171 all to Addington et al.

Drum type continuous miners generally incorporate a gearcase of conventional design. As shown in FIGS. 1 and 1*a*, the conventional or prior art gearcase design includes a bevel gear set including an input pinion A and output bevel gear B. The output bevel gear B drives a hollow sun gear C which meshes with planetary gear set D carried by rotating planetary carrier E. The planetary gears D also mesh with a fixed ring gear F. It is the rotating planetary carrier E that drives the end cutting drum (not shown). A main drive shaft G connected to the planetary gear set carrier E drives the middle cutting drum (not shown).

In an alternative prior art embodiment shown in FIG. 1*b*, two matching mirror-image gearcases substantially corresponding in design to the gearcase shown and described in FIGS. 1 and 1*a* are interconnected by the main drive or cross shaft G.

It should be appreciated that the main drive shaft G in either of the above-described prior art embodiments must be of sufficient size and strength to transmit the horsepower from the drive motor (e.g. 125–350 horsepower) through the rotating planetary carrier E to the middle cutting drum. Accordingly, a solid, high-strength steel shaft of between 9–15 centimeters in diameter is typically employed. As shown in FIG. 1, the sun gear C must be of sufficient diameter to accommodate a centerbore of sufficient size to provide clearance for the main drive shaft G.

In all gearcase designs of this type, it is the size or overall diameter of the planetary gear set which dictates or limits the overall size of the gearcase. In this conventional design, the planetary gear set must orbit the sun gear C which must be sized of sufficient diameter to accommodate passage of the main drive shaft G. Since the main drive shaft G must be of sufficient diameter to transmit horsepower to the center cutting drum without failure, any possible reduction in the outer diameter of the planetary gear set D and therefore the gearcase is strictly limited. This in turn means that any possible reduction in the diameter of the cutting drums which fit concentrically over the gearcases is also limited. This in turn means that the mining apparatus is only capable of efficiently mining relatively thick seams: that is, seams having a thickness at least equal to or greater than the outer diameter of the cutting drums. The cost of cleaning the won coal becomes prohibitively expensive if an attempt is made to mine thinner seams.

As more and more of the world's coal reserves are contained in relatively thin seams, a need is therefore identified for an improved gearcase design that allows the outer diameter of the gearcase and its component parts to be reduced. This in turn allows the working diameter of the cutting drums to be reduced so as to allow efficient and cost effective operation in relatively thinner seams.

SUMMARY OF THE INVENTION

Accordingly, it is a primary object of the present invention to provide a mining apparatus in the form of a continuous miner overcoming the above-described limitations and disadvantages of the prior art.

Another object of the present invention is to provide a mining apparatus particularly suited for the efficient mining of relatively thin mineral seams.

Still another object of the present invention is to provide a continuous miner for utilization as part of a highwall mining system capable of mining thin seams in a cost efficient manner.

Yet another object of the present invention is to provide a unique gearcase of compact design and reduced diametrical dimension capable of reliably transmitting high horsepower between a drive motor and a cutting drum of a mining apparatus.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved apparatus is provided for mining a mineral seam. The apparatus includes a frame and means for propelling the apparatus into the mineral seam. Additionally, the apparatus includes first and second cutters carried on the frame and a cooperating cutter motor for winning aggregate material from the mineral seam. The apparatus is, however, more particularly characterized by its unique transmission gearcase. That transmission gearcase has a bevel gear set, first and second sun gears, first and second planetary gear sets, first and second fixed planetary gear set carriers for carrying the first and second planetary gear sets, respectively, and first and second rotating ring gears. Output from the cutter motor is connected to the bevel gear set. The bevel gear set in turn drives the first and second sun gears that drive, respectfully, the first and second planetary gear sets. These planetary gear sets, respectively, drive the first and second ring gears. The first ring gear travels or rotates around the first planetary gear set and the second ring travels or rotates around the second planetary gear set. The first and second ring gears are connected, respectively, to the first and second cutters.

By means of this gearcase arrangement, the power from the drive motor is effectively transmitted to the first and second cutters. Advantageously, this arrangement eliminates the provision of a main or center drum drive shaft as provided in the conventional design described above. Accordingly, the sun gear does not need to be made of sufficient diametrical dimension to accommodate a bore to allow the passage of the main drive shaft. As a result, the sun gears may be made substantially smaller in diametrical dimension. This is also true of the concentrically disposed planetary gear carriers and planetary gear sets as well as the rotating ring gears. Thus, the overall diametrical dimension of the gearcase may be significantly reduced. Thus, the new gearcase accommodates and effectively operates with cutting drums of reduced overall diameter. This allows the mining apparatus equipped with the gearcase to operate more cost efficiently in relatively thin seams. This is a particularly important attribute of the present invention since the majority of the remaining coal reserves in the world are in relatively thin seams for which cost efficient mining with a mining apparatus of this type has previously not been possible.

In accordance with yet another aspect of the present invention, the present invention relates to the specific transmission gearcase described and particularly adapted for use in a mining apparatus such as a drum-type continuous miner. More specifically describing the transmission gearcase, the first sun gear is preferably provided adjacent a first end of the gearcase while the second sun gear is preferably provided adjacent a second, opposite end of the gearcase. A drive shaft is provided for operatively connecting the bevel gear set and the first and second sun gears. This drive shaft is supported for relative rotation and rides in a series of bearings in the gearcase housing.

The longitudinal dimension of the gearcase is minimized by providing the first sun gear so that it is concentrically received in the first planetary gear set and the first planetary gear set so that it is concentrically received within the first ring gear. Similarly, the second sun gear is concentrically received within the second planetary gear set and the second planetary gear set is concentrically received within the second ring gear.

Not only does this gearcase arrangement occupy a significantly reduced diametrical dimension, it should also be appreciated that it is capable of matching or exceeding the horsepower transmission capabilities of a substantially larger gearcase of conventional design. Accordingly, the gearcase of the present invention allows the application of equivalent or greater horsepower to a relatively smaller cutter drum for the most cost efficient and effective mining of thin seams available in the coal mining industry today.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 4 is a detailed cross-sectional view of the new transmission gearcase of the present invention; and FIG. 4*a* is a transverse cross-sectional view of the transmission gearcase shown in FIG. 4.

Reference will now be made in detail to the present preferred embodiment of the invention, an example of which is illustrated in the accompanying drawing.

DETAILED DESCRIPTION OF THE INVENTION

Figure 2A:
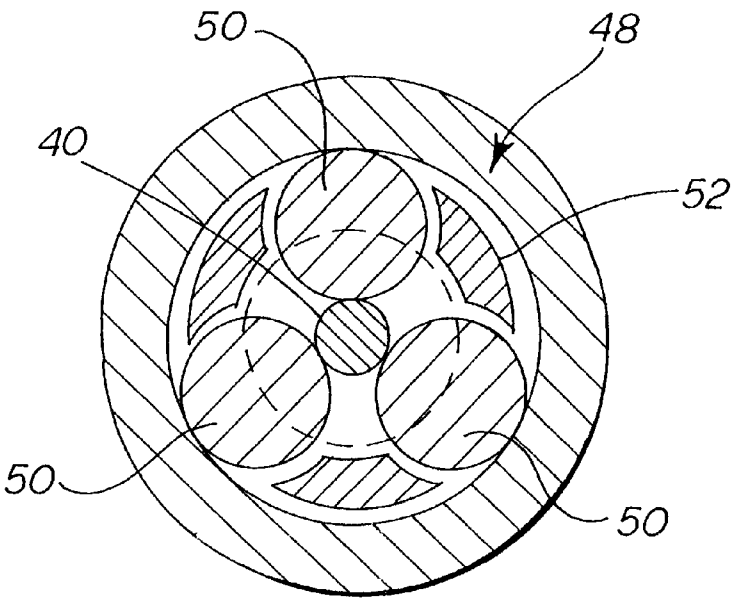
FIG. 2 is a perspective view showing the mining apparatus of the present invention equipped with the new transmission gearcase.
Figure 2:
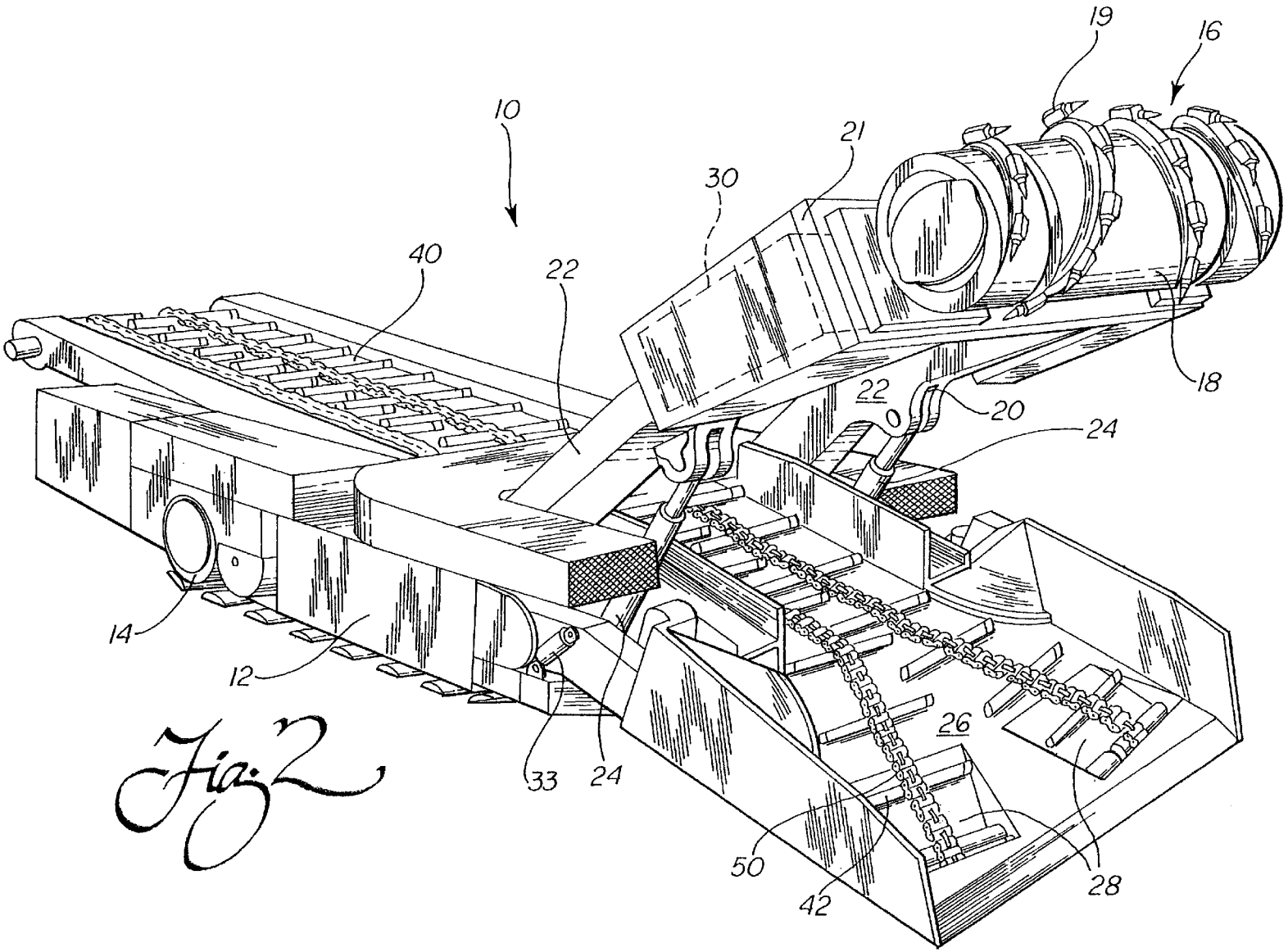

Reference is now made to FIG. 2 showing an apparatus 10 for mining aggregate material from a mineral seam. Such a mining machine 10 may be utilized in a highwall mining system of the type described in U.S. Pat. Nos. 5,112,111; 5,261,729 and 5,364,171 all to Addington et al. owned by the assignee of the present invention. The full disclosure presented in these patent documents is incorporated herein by reference.

As shown, the mining machine 10 includes a main frame 12 supported for movement or propulsion relative to the ground by means of crawler or caterpillar assemblies 14, one on each side of the mining machine. The crawler assemblies 14 are powered by electric or hydraulic motors (not shown) carried on the frame 12 in a manner well known in the art.

The mining machine 10 also includes a means, generally designated by reference numeral 16, for cutting an opening in and winning aggregate material from the mineral seam. More particularly, the cutting and winning means 16 includes a three piece rotary mineral cutting drum assembly 18 carried on the forward end of a boom 20 that is pivotally mounted to the frame 12. As known in the art, the cutting drum assembly 18 includes a series of picks 19 for ripping, breaking or cutting aggregate material from the mineral seam for subsequent recovery.

The boom 20 includes a bulkhead 21 that interconnects a pair of spaced, lateral arms 22, each arm being pivotally mounted to the frame through a trunnion (not shown). A pair of hydraulic actuators 24 allow the selective angular positioning of the boom 20 relative to the frame 12. Thus, the boom 20 and, therefore, the cutting drum assembly 18 may be raised and lowered as the mining machine 10 is advanced into the mineral seam so that aggregate material is cut from the full vertical dimension of the seam. This material is collected in an underlying loading shovel 26 and delivered into a twin chain conveyor 28 for subsequent recovery in a manner known in the art.

Figure 3:
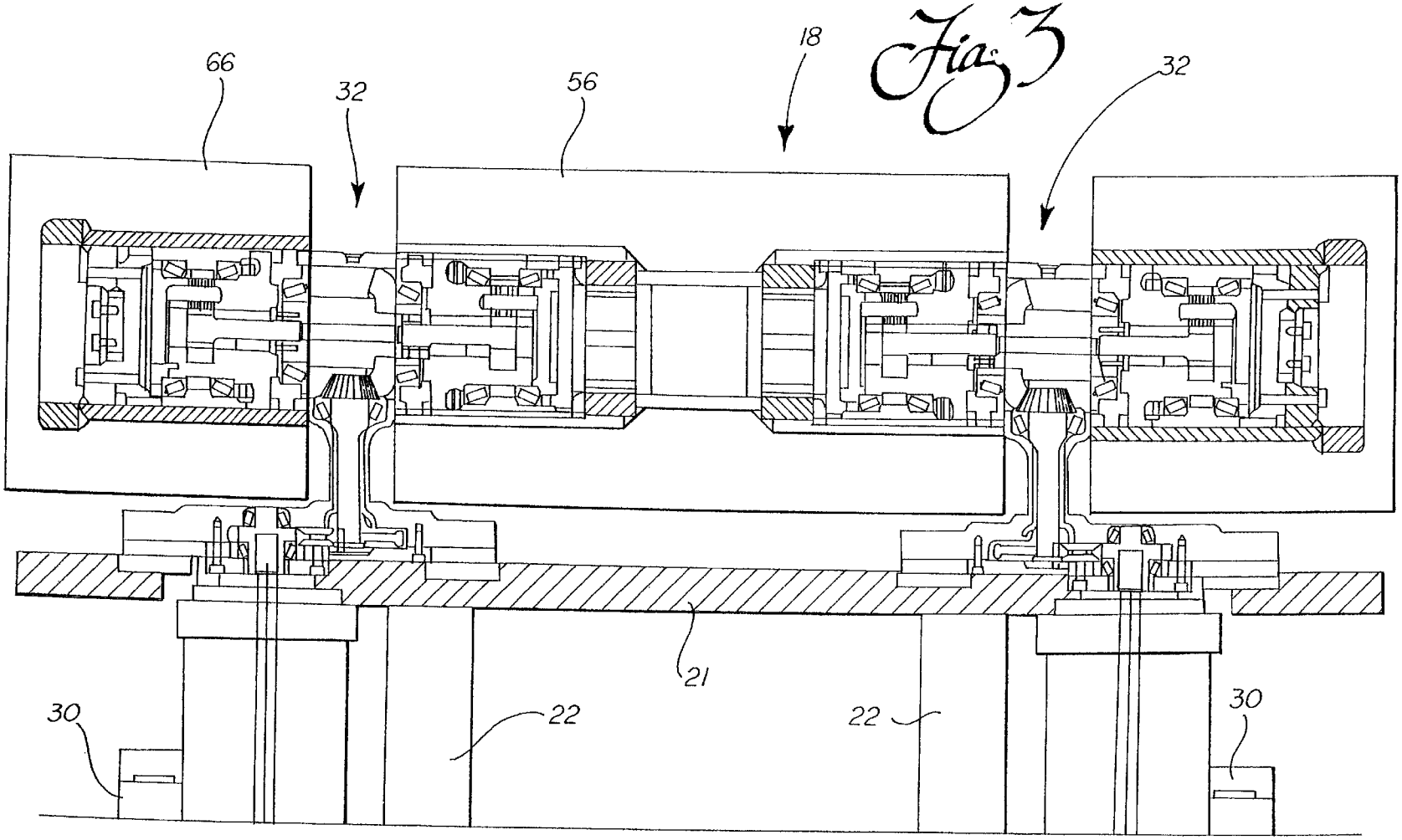
FIG. 3 is a detailed partially cross-sectional view of the mining apparatus shown in FIG. 2 illustrating the boom, cutter drum assembly and cutter drum transmission.
Figure 7:
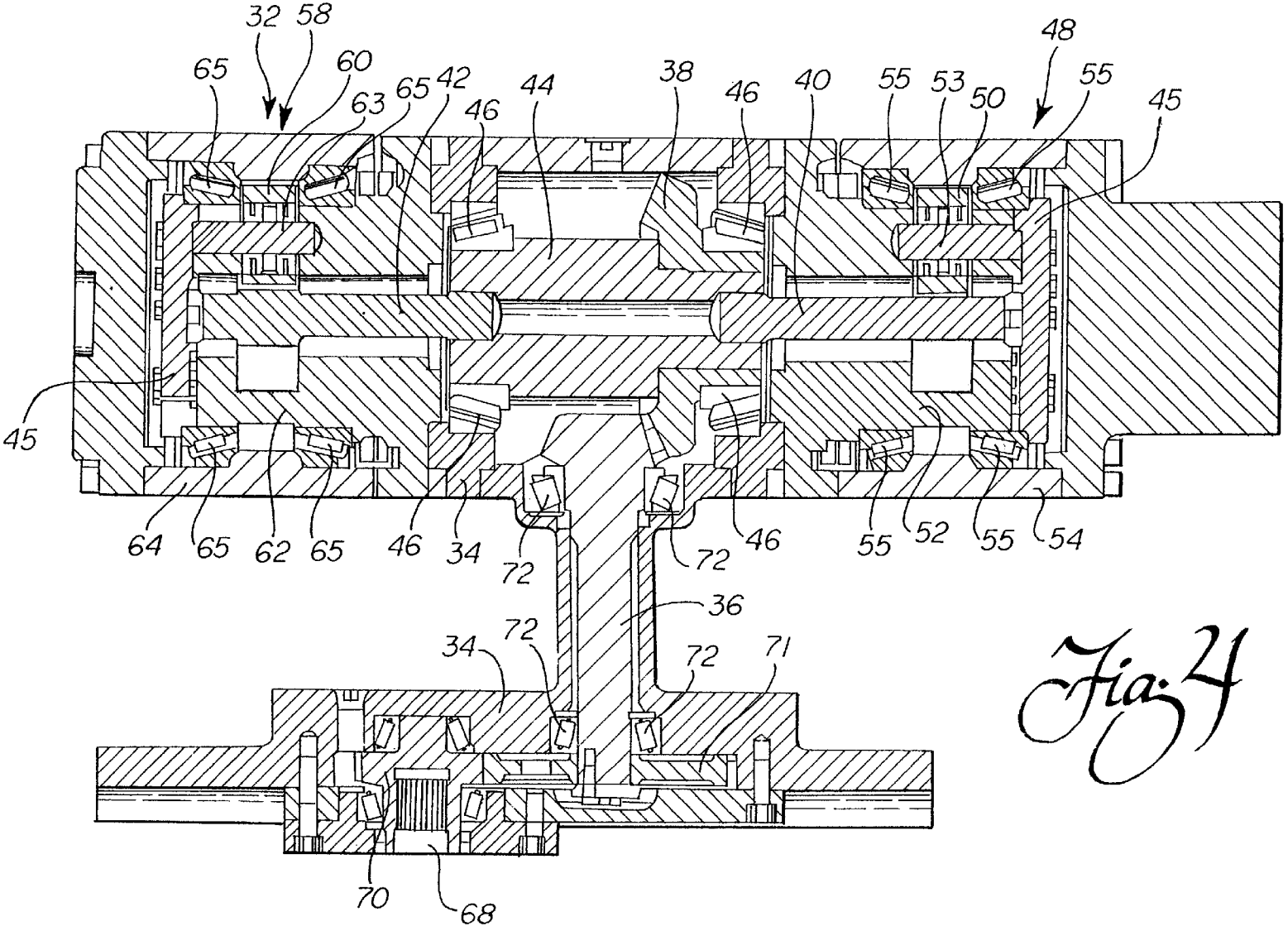

As should also be appreciated, one motor 30 and a cooperating gearcase 32 are carried by each arm 22 to drive the cutting drum assembly 18 (see FIG. 3). It is the unique design of the gearcases 32 that allows the cost efficient mining of relatively thin mineral seams utilizing the present mining apparatus 10. The structural arrangement and design of each gearcase 32 is best shown and illustrated in FIGS. 4 and 4*a*. Only one gearcase 32 is shown in FIGS. 4 and 4*a* and will be described in detail below. The other gearcase 32 is of substantially identical design but is layed out as a mirror image of the one illustrated (see FIG. 3).

As shown in FIGS. 3 and 4, the gearcase 32 includes a housing 34 that is carried by and mounted to the bulkhead of boom 20. Contained within the housing 34 is a bevel gear set including input pinion bevel gear 36 and cooperating output bevel gear 38. Also contained in the gearcase 32 are first and second sun gears 40, 42, respectively, positioned adjacent opposite ends of the gearcase. The output bevel gear 38, first sun gear 40 and second sun gear 42 are all keyed or otherwise fixed to the drive shaft 44 held for relative rotation in the housing 34 by means of bearings 46. More specifically, the sungears 40, 42 are axially mounted in opposite ends of the drive shaft 44 by means of integral solid metal stub shafts. A thrust washer and bearing assembly 45 at each end of the gearcase allows for free rotation of the sungears 40, 42 relative to the housing.

As further shown in FIG. 4 and also illustrated in FIG. 4*a*, the first sun gear 40 is concentrically received within a first planetary gear set 48 comprising three separate gears 50 carried by a first, planetary gear set carrier 52 fixed to the housing 34 by pin 53 or other means. The first planetary gear set 48 is concentrically received within a first, outer rotating ring gear 54. This first ring gear 54 rotates on bearings 55 about the first planetary gear set 48 and drives the first or middle cutter drum 56 of the cutter drum assembly 18 (see also FIG. 3).

Similarly, the second sun gear 42 is concentrically received in the second planetary gear set 58 comprising three gears 60 carried by the fixed second planetary gear set carrier 62 also fixed to the housing by pin 63 or other means. The second platentary gear set 58 is concentrically received within the second ring gear 64. The second ring gear 64 rotates on bearings 65 around the gears 60 of the second planetary gear set 58 and drives the second or outer cutter drum 66.

In operation, the output shaft 68 of the cutter drum drive motor 30 is operatively connected by the output gear 70 to the spur gear 71 on input pinion bevel gear 36. The drive motor 30 thereby rotates the input pinion bevel gear 36 which is held for rotation relative to the housing 34 by means of the bearings 72. Rotation of the pinion bevel gear 36 in turn rotates the output bevel gear 38. Output bevel gear 38 is keyed to the main drive shaft 44. The first and second axially aligned sun gears 40, 42 are also keyed to this shaft 44. Accordingly, the sun gears 40, 42 are also rotated. The first and second sun gears 40, 42 engage and mesh respectively with the first and second planetary gear sets 48, 58.

The first and second planetary gear sets 48 and 58 are carried by the respective first and second planetary gear set carriers 52, 62 which are fixed to the housing 34. The gears 50 and 60, respectively, mesh with and drive the first and second ring gears 54, 64. These ring gears 54, 64 are thereby rotated so as to revolve around the first and second planetary gear sets 48, 58. The ring gears 54, 64 operatively engage and mesh with the first and second cutting drums 56, 66. In this way, power is transmitted from the drive motor 30 to the first and second cutting drums 56, 66 of the cutter drum assembly 18.

Figure 1:
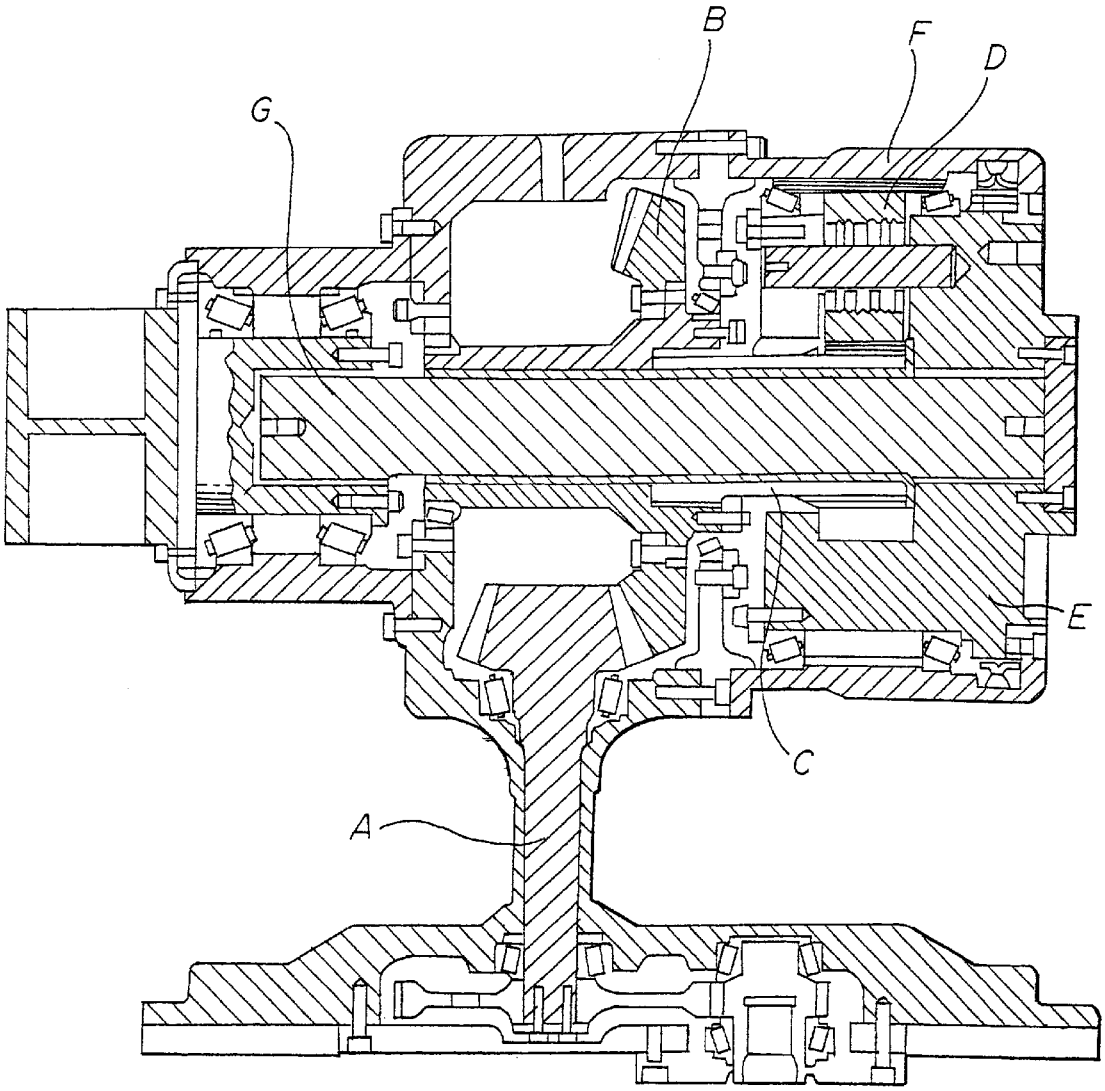
Fig. 1 PRIOR ART
FIG. 1 is a cross-sectional view of a transmission gearcase for a continuous miner of conventional or prior art design.
Figure 1A:
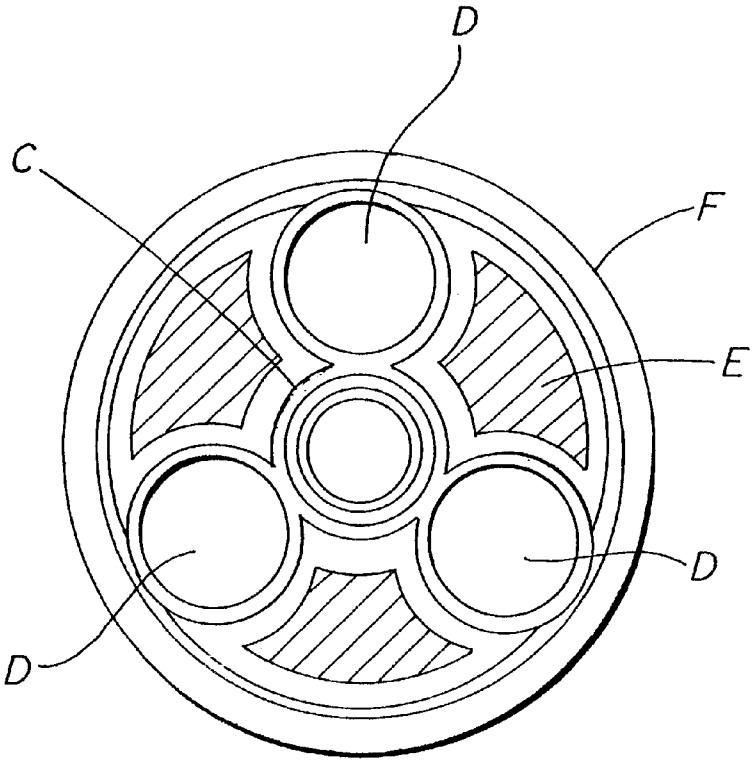
Fig. 1a PRIOR ART
FIG. 1*a* is a transverse cross-sectional view of the conventional or prior art transmission gearcase shown in FIG. 1.
Figure 1B:
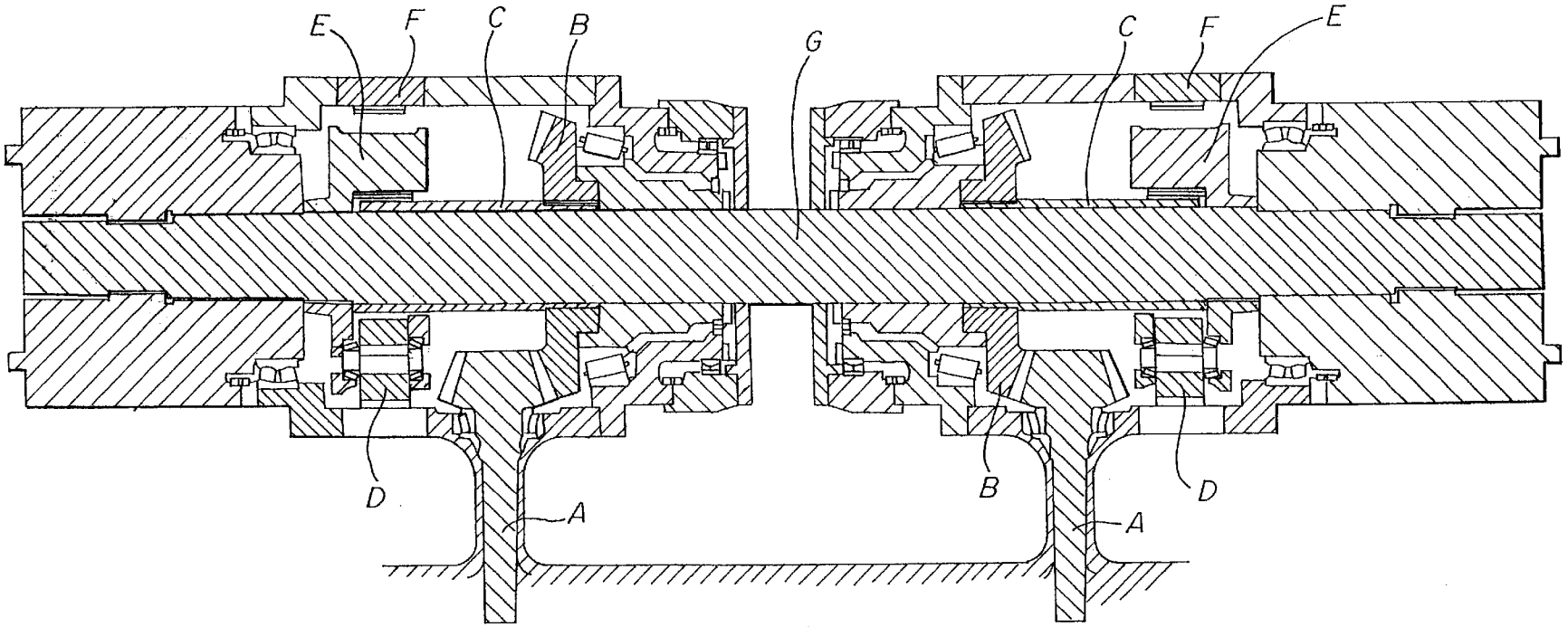
Fig. 1b PRIOR ART
FIG. 1*b* is a cross-sectional view of an alternative prior art gearcase embodiment incorporating a cross shaft.

As noted above, the unique design of the present invention including the axial alignment of the first and second sun gears 40, 42 with the main drive shaft 44 keyed to the output bevel gear 38 allows minimization of the diametrical dimension of the transmission gearcase 32. This means that the gearcase may be fitted to drive a cutter drum assembly 18 of reduced diametrical dimension. Such a cutter drum assembly 18 may be effectively utilized to more cost efficiently mine coal or other mineral from relatively thin seams. In fact, the diametrical dimension of the gearcase of the present invention may be reduced by as much as 25% from a gearcase of conventional design as shown in FIG. 1. This allows a similar reduction in the diametrical dimension of the cutter drum assembly 18. Accordingly, whereas gearcases and cutter drum assemblies of conventional design as shown in FIG. 1 can only be effectively utilized for the cost efficient mining of mineral seams of at least 38 inches in thickness, a mining apparatus outfitted with the gearcase 32 of the present invention may be utilized to cost effectively mine coal seams of as little as 28 inches in thickness. This represents a very significant advantage and advance in the art since this is the first time coal seams of this reduced thickness may be cost efficiently mined with a drum-type continuous miner.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An apparatus for mining a mineral seam, comprising:

a frame;

first and second cutters carried on said frame for winning aggregate material from the mineral seam;

a cutter motor for driving said first and second cutters; and a gearcase for transmitting power from said cutter motor to said first and second cutters, said gearcase including a bevel gear set, first and second sun gears, a drive shaft for connecting said bevel gear set to said first and second sun gears, first and second planetary gear sets, first and second fixed planetary gear set carriers for carrying, respectively, said first and second planetary gear sets and first and second ring gears, said cutter motor being connected to said bevel gear set that drives said first and second sun gears that drive, respectively, said first and second planetary gear sets that drive, respectively, said first and second ring gears; said first ring gear rotating around said first planetary gear set so as to drive said first cutter and said second ring gear rotating around said second planetary gear set so as to drive said second cutter.

2. The apparatus of claim 1, further including means for propelling said apparatus into the mineral seam, said propelling means being carried on said frame.

3. The apparatus of claim 1, wherein said first sun gear is provided adjacent a first end of said gearcase and said second sun gear is provided adjacent a second, opposite end of said gearcase.

4. The apparatus of claim 1, wherein said first sun gear is concentrically received within said first planetary gear set and said first planetary gear set is concentrically received within said first ring gear.

5. The apparatus of claim 4, wherein said second sun gear is concentrically received within said second planetary gear set and said second planetary gear set is concentrically received within said second ring gear.

6. A gearcase for transmitting power from a cutter motor to first and second cutters of a mining apparatus, comprising:

a bevel gear set;

first and second sun gears;

a drive shaft for connecting said bevel gear set to said first and second sun gears;

first and second planetary gear sets;

first and second fixed planetary gear set carriers for carrying respectively said first and second planetary gear sets; and first and second ring gears for driving said first and second cutters;

said gearcase being characterized by said bevel gear set driving said first and second sun gears that drive, respectively, said first and second planetary gear sets that drive respectively, said first and second ring gears, said first ring gear rotating around said first planetary gear set so as to drive said first cutter and said second ring gear rotating around said second planetary gear set so as to drive said second cutter.

7. The apparatus of claim 6, wherein said first sun gear is provided adjacent a first end of said gearcase and said second sun gear is provided adjacent a second, opposite end of said gearcase.

8. The apparatus of claim 6, wherein said first sun gear is concentrically received within said first planetary gear set and said first planetary gear set is concentrically received within said first ring gear.

9. The apparatus of claim 8, wherein said second sun gear is concentrically received within said second planetary gear set and said second planetary gear set is concentrically received within said second ring gear.

* * * * *